US006675519B2

(12) United States Patent
Hyytinen

(10) Patent No.: US 6,675,519 B2
(45) Date of Patent: Jan. 13, 2004

(54) LOCKING METHOD AND ARRANGEMENT FOR A GUN

(75) Inventor: Timo Hyytinen, Jyväskylä (FI)

(73) Assignee: Sako Oy, Riihimaki (FI)

( * ) Notice: Subject to any disclaimer, the term of this patent is extended or adjusted under 35 U.S.C. 154(b) by 0 days.

(21) Appl. No.: 10/148,766

(22) PCT Filed: Dec. 1, 2000

(86) PCT No.: PCT/FI00/01060

§ 371 (c)(1),
(2), (4) Date: Nov. 13, 2002

(87) PCT Pub. No.: WO01/40732

PCT Pub. Date: Jun. 7, 2001

(65) Prior Publication Data

US 2003/0089016 A1 May 15, 2003

(30) Foreign Application Priority Data

Dec. 3, 1999 (FI) ..... 19992604

(51) Int. Cl.[7] ..... F41A 17/64
(52) U.S. Cl. ..... 42/70.08; 42/70.01; 42/70.11
(58) Field of Search ..... 42/70.01, 70.08, 42/70.11

(56) References Cited

U.S. PATENT DOCUMENTS

| | | | | |
|---|---|---|---|---|
| 2,945,316 A | | 7/1960 | Mulno | |
| 3,553,877 A | | 1/1971 | Welch | |
| 3,750,319 A | * | 8/1973 | Roy | 42/70.08 |
| 3,830,002 A | * | 8/1974 | Volkmar | 42/70.08 |
| 3,882,622 A | | 5/1975 | Perlotto | |
| 3,942,278 A | * | 3/1976 | Schaller et al. | 42/70.08 |
| 4,312,263 A | * | 1/1982 | Bourlet | 89/154 |
| 4,313,274 A | * | 2/1982 | Ludwig et al. | 42/70.08 |
| 4,726,136 A | * | 2/1988 | Dornaus et al. | 42/70.08 |
| 5,267,407 A | * | 12/1993 | Bornancini | 42/70.08 |
| 5,426,881 A | * | 6/1995 | Ruger | 42/70.08 |
| 5,437,120 A | * | 8/1995 | Dornaus | 42/70.08 |
| 6,145,234 A | * | 11/2000 | Fluhr | 42/70.08 |
| 6,240,670 B1 | * | 6/2001 | Findlay | 42/70.08 |

(List continued on next page.)

FOREIGN PATENT DOCUMENTS

| | | |
|---|---|---|
| DE | 0304280 | * 3/1920 |
| DE | 0200967 | * 12/1958 |
| DE | 4300532 | 7/1994 |

*Primary Examiner*—Michael J. Carone
*Assistant Examiner*—Troy Chambers
(74) *Attorney, Agent, or Firm*—Wolf, Greenfield & Sacks, P.C.

(57) ABSTRACT

The invention relates to a method for locking a gun that includes a firing pin and a lock cylinder provided with a lock cylinder bracket. The method comprises providing the firing pin with a recess that essentially conforms to the lock cylinder bracket both in shape and in size, wherein the bracket has at least two positions including a first position and a second position, and that in the first position, the bracket is fitted in the recess, so that the firing pin is movable towards the lock cylinder; and that in the second position, the bracket is not fitted in the recess, thereby preventing the firing pin from moving towards the lock cylinder and consequently locking the gun. The invention also relates to a locking arrangement for a pinlock of a gun. The locking arrangement comprises a lock cylinder provided with a bracket, and a firing pin provided with a recess that essentially conforms to the lock cylinder bracket both in shape and in size. The bracket has at least two positions including a first position and a second position. In the first position, the bracket is fittable in the recess and the firing pin is movable towards the lock cylinder. In the second position, the bracket is not fittable in the recess, thus preventing the firing pin from moving towards the lock cylinder, so that it locks the gun and prevents the cocking thereof.

9 Claims, 3 Drawing Sheets

U.S. PATENT DOCUMENTS 6,260,298 B1 * 7/2001 Bubits ..... 42/70.08
6,338,217 B1 * 1/2002 Viani ..... 42/70.08
6,349,495 B1 * 2/2002 Fluhr ..... 42/70.08
6,357,155 B1 * 3/2002 Amadini ..... 42/70.11
6,363,646 B1 * 4/2002 Amadini ..... 42/70.11
6,405,470 B1 * 6/2002 Strahan ..... 42/70.08
6,510,641 B1 * 1/2003 Viani ..... 42/70.08
6,530,168 B2 * 3/2003 Shimi et al. ..... 42/70.08
2002/0020099 A1 * 2/2002 Silveira

* cited by examiner

LOCKING METHOD AND ARRANGEMENT FOR A GUN

FIELD OF THE INVENTION

The invention relates to a method for locking a gun that includes a firing pin. Further, the invention relates to a locking arrangement for a pinlock of a gun.

DESCRIPTION OF RELATED ART

According to the new law on firearms, firearms must be locked when they are being stored. Guns can be stored for instance in a locked closet, or their pinlock can be removed and kept in a locked place; the trigger can be locked either by means of a separate locking arrangement, or the gun can be locked in a wall rack at the trigger guard.

As such, keeping guns in a locked closet is a good way to prevent the guns from getting into wrong hands, for instance to those of children or burglars—but on the other hand, it is fairly easy to break into closets, whereafter the guns are available in full readiness for usage. Likewise, the removing of the pinlock makes a gun unusable as such, but still it is fairly easy to break into locked closets. Various trigger locking arrangements are also easily broken or drilled open, so that the gun is made fully operable. The object of the invention is to realise a locking method and arrangement whereby a gun can be locked so that it becomes impossible to use them without authorisation. In particular, the object of the invention is to realise a locking arrangement that cannot be broken without breaking the gun at the same time, i.e. that cannot be forced open so that the gun remains operable.

SUMMARY OF THE INVENTION

The method and locking arrangement according to the invention are defined by what is specified in the appended claims.

According to one aspect of the invention, a method is provided for locking a gun that includes a firing pin a lock cylinder provided with a lock cylinder bracket. The method includes providing the firing pin with a recess that essentially conforms to the lock cylinder bracket both in shape and in size, and that wherein the bracket has at least two positions including a first position and second position, and that in the first position, the bracket is fitted in the recess, so that the firing pin is movable towards the lock cylinder; and that in the second position, the bracket is not fitted in the recess, thereby preventing the firing pin from moving towards the lock cylinder, so that it locks the gun.

According to another aspect of the invention a locking arrangement is provided for a pinlock of a gun. The locking arrangement comprises: a lock cylinder provided with a bracket, and a firing pin that is provided with a recess that essentially conforms to the lock cylinder bracket both in shape and in size. The bracket has at least two positions including a first position and second position. In the first position, the bracket is fittable in the recess, and the firing pin is movable towards the lock cylinder. In the second position, the bracket is not fittable in the recess, thus preventing the firing pin from moving towards the lock cylinder, so that it locks the gun and prevents the cocking thereof.

The locking arrangement according to the invention can advantageously be applied to rifles and more particularly to rifle pinlocks. The purpose of a rifle pinlock is, among others, to lock the cartridge in the cartridge chamber.

The locking arrangement according to the invention is simple and has few moving parts, wherefore it is well resistant to treatment in various weather conditions, for instance in rain or in temperatures below zero.

According to a preferred embodiment of the invention, said lock cylinder can neither be removed from the gun by force, so that the gun should remain in working order, nor opened without a device designed for opening said locking arrangement. Advantageously the device designed for opening the arrangement is a key, whereby the lock cylinder bracket can be arranged in its different positions. Thus the locking arrangement according to the invention fulfils the requirements stipulated in the law on firearms as regards the locking of guns. Moreover, for the owner of a gun the arrangement according to the invention is easy to use, because all he needs to do is to remove the key or other device designed for opening the lock.

In appearance, said device can be made similar to ordinary keys, for instance Abloy® keys, in which case the key can be kept for example in a key ring or in the office, and it is impossible for other people to notice that the key belongs to a gun.

A particular advantage of the locking arrangement according to the invention is that the gun remains locked also during transportation, without any extra locking systems. When desired, the gun can be swiftly arranged to operating condition.

According to a preferred embodiment of the invention, the key or other device cannot be removed from the lock cylinder, when the bracket is in its first position.

According to another embodiment of the invention, said key or other device can be removed from the lock cylinder when the bracket is in its first position. Obviously, if the key can be removed from the lock cylinder when the gun is in use, it is advantageous to cover the keyhole with a protection known as such in the prior art for protecting the lock cylinder against dirt and moisture. According to another preferred embodiment of the invention, the key comprises two parts that can be detached from each other. This embodiment is described in more detail below.

Further, the locking arrangement according to the invention can be arranged in a gun already at the manufacturing stage, or it can be installed afterwards in a ready-made gun, so that for instance the butt end of the lock and the firing pin are replaced. Thus the arrangement according to the invention can be applied in a very versatile fashion.

For a man skilled in the art, it is apparent that the locking method and arrangement according to the invention can also be realised so that the firing pin is provided with a bracket, and the lock cylinder is provided with a recess that essentially conforms to said bracket both in shape and in size.

BRIEF DESCRIPTION OF THE DRAWINGS

The invention is explained in more detail with reference to the appended drawings, where.

DETAILED DESCRIPTION

Figure 1:
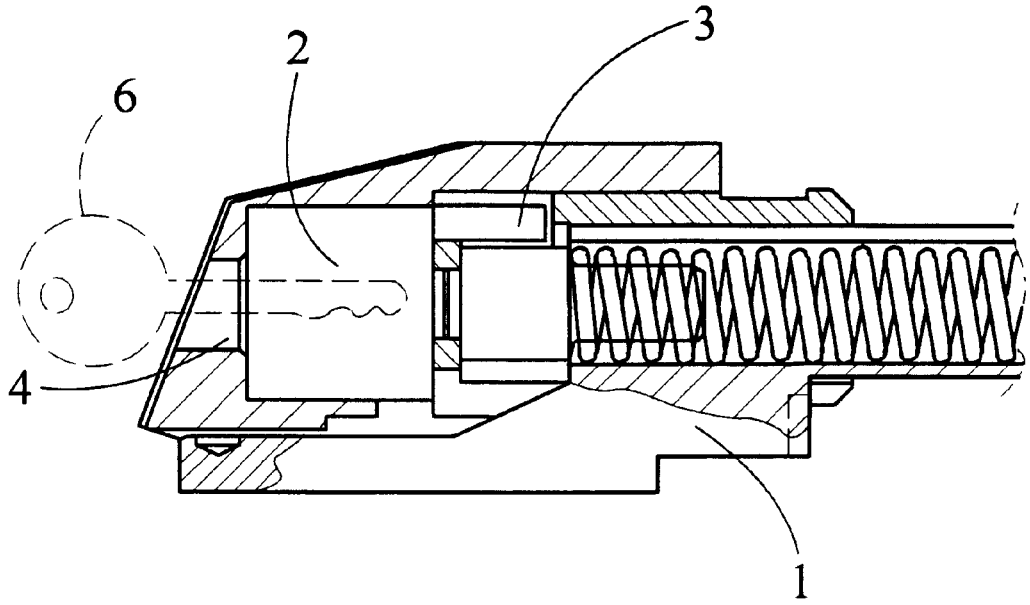
FIG. 1 is a side-view illustration of a locking arrangement according to a first embodiment of the invention, seen in a locked position.

FIG. 1 is a side-view illustration of a locking arrangement according to the first embodiment of the invention, seen in the locked position. There are shown a firing pin 1, a lock cylinder 2, a lock cylinder bracket 3, a lock cylinder keyhole 4 and a key 6. The locking arrangement is locked, i.e. the bracket 3 is in its second position, where it is not fitted in the recess provided in the firing pin 1, and consequently the firing pin is prevented from moving backwards, towards the lock cylinder, which means that the gun cannot be cocked.

Figure 2:
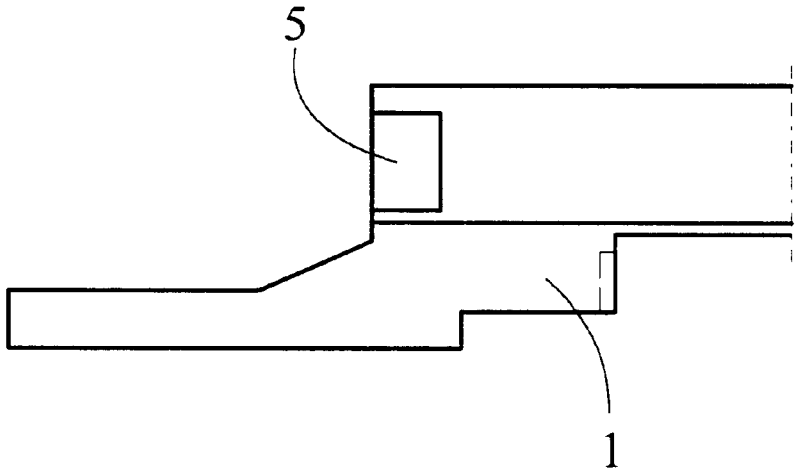
FIG. 2 is a side-view illustration of a firing pin according to the first embodiment of the invention.

FIG. 2 is a side-view illustration of a firing pin according to the first embodiment of the invention. There is shown a recess 5 of the firing pin 1, which essentially conforms to the lock cylinder bracket 3 both in size and in shape. Naturally the firing pin can be realised in some other shape, too.

Figure 3:
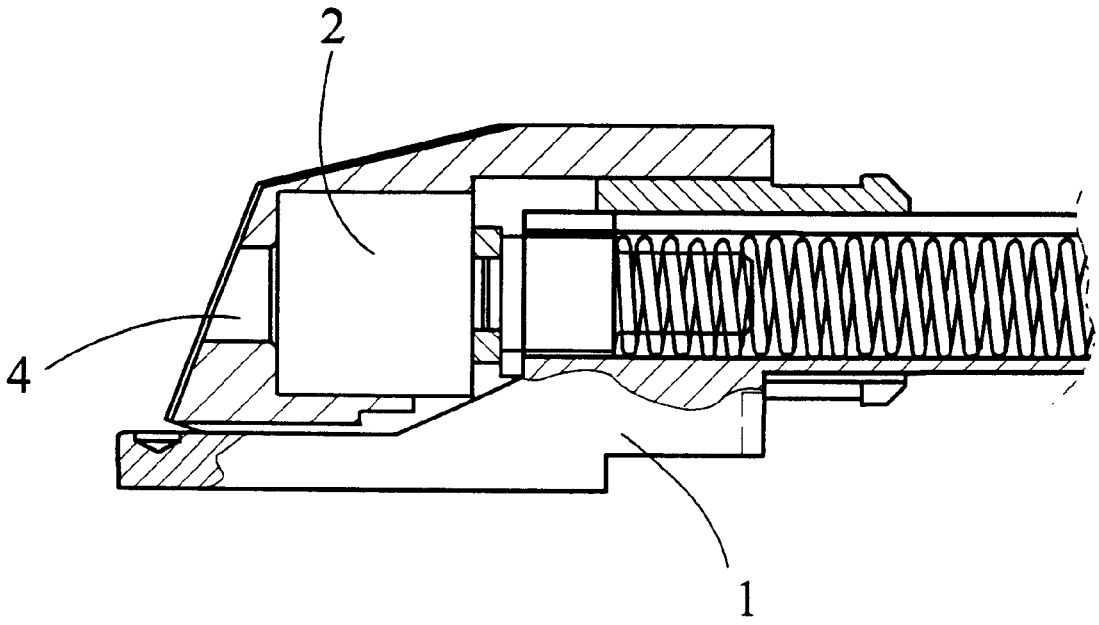
FIG. 3 is a side-view illustration of a locking arrangement according to the first embodiment of the invention, seen in an open position.

FIG. 3 is a side-view illustration of a locking arrangement according to the first embodiment of the invention, seen in an open position. There are shown a firing pin 1, a lock cylinder 2 and a lock cylinder keyhole 4. In the drawing, the lock cylinder is open, i.e. the bracket 3, which is not illustrated, is in its first position, where the bracket 3 is fitted in the recess of the firing pin, so that the firing pin can move backwards towards the lock cylinder, and the gun can be cocked. In the drawing, the firing pin 1 is illustrated as drawn backwards, towards the lock cylinder, in relation to the locked locking arrangement illustrated in FIG. 1.

Figure 4A:
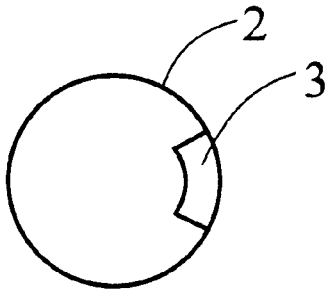
FIG. 4*a* is an end-view illustration of a lock cylinder according to the first embodiment of the invention.
Figure 4B:
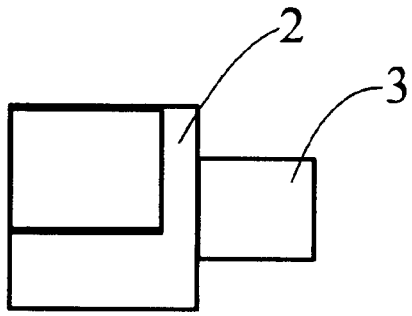
FIG. 4*b* is a top-view illustration of a lock cylinder according to the first embodiment of the invention.

FIG. 4*a* illustrates a lock cylinder according to the first embodiment of the invention, seen at the end on the firing pin side. The lock cylinder 2 is provided with a bracket 3, which here has the shape of a truncated cone with a curved bottom. Naturally the bracket 3 can have some other shape, too. FIG. 4*b* shows the lock cylinder 2 and its bracket 3 according to the first embodiment of the invention as seen from the top.

Figure 5A:
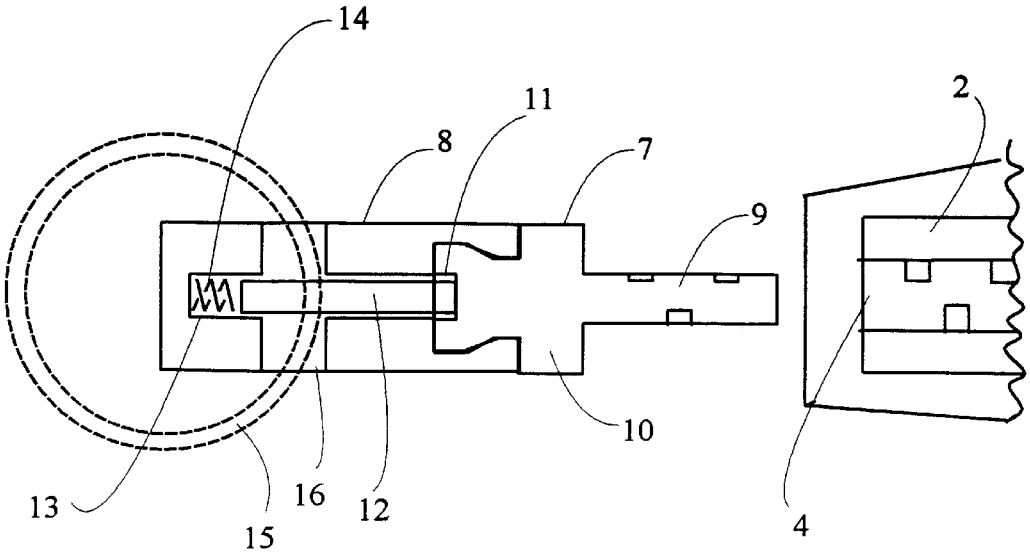
FIG. 5*a* is a top-view illustration of a key arrangement according to a second embodiment of the invention, shown in a first position.

FIG. 5*a* is a top-view illustration of a key arrangement according to a second embodiment of the invention, shown in cross-section in its first position. The key according to the second embodiment has two parts, and it comprises both a key part 7 and a turning part 8. The key part 7 includes the key pin 9, which is constructed according to a known technique and can be inserted in the keyhole 4 of the lock cylinder 2. In addition, the key part 7 comprises a housing 10 provided with a slot 11. The turning part 8 comprises a bracket 12 provided with a first head that can be fitted in the slot 11. The bracket 12 is arranged in a tube 13, and springs 14 are provided at the other end of said bracket 12. The springs 14 hold the bracket 12 in its extreme position, so that the turning part 8 cannot by itself be removed from the key part 7. Moreover, in the middle region of the bracket 12, there is arranged a loop 15. Said loop 15 is arranged to proceed in an aperture 16 drilled in the turning part 8. The aperture 16 is made sufficiently large in order to enable the pulling of the bracket 12 backwards by means of the loop 15, so that the turning part 8 can be detached from the key part 7.

Figure 5B:
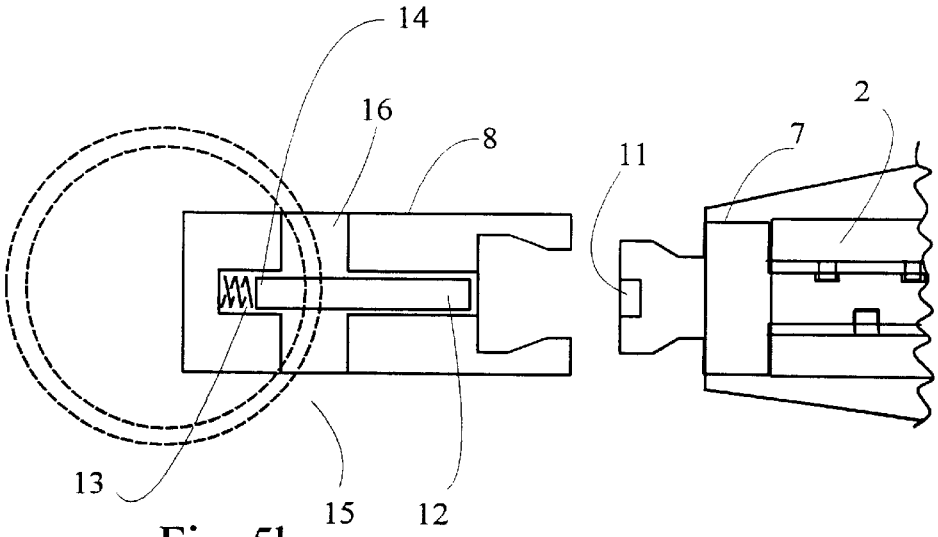
FIG. 5*b* is a top-view illustration of a key arrangement according to the second embodiment of the invention, shown in a second position.

FIG. 5*b* is a top-view illustration of a key arrangement according to the second embodiment of the invention, shown in cross-section in its second position. In said second position, the key part 7 is fitted in the lock cylinder 2, and the turning part 8 is detached from the key part 7. The purpose of this embodiment is to enable the use of the gun without having a big disturbing key attached thereto. At the same time, the key part protects the lock cylinder for instance against moisture and dirt that can get into the lock cylinder, if the key is completely removed when the gun is being used. As was already explained above, it is obvious that other types of arrangement can be used in the invention for protecting the lock cylinder. Likewise, it is obvious for a man skilled in the art that the detaching of the turning part alone from the gun is not sufficient for locking the gun in the way stipulated in the law of firearms.

Figure 5C:
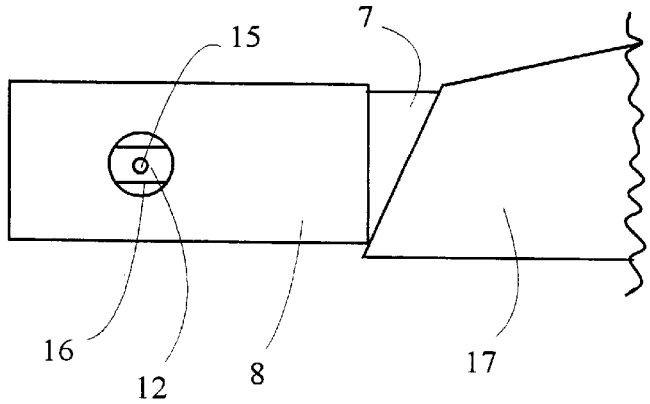
FIG. 5*c* is a side-view illustration of a key arrangement according to the second embodiment of the invention, shown in a third position.

FIG. 5*c* is a side-view illustration of a key arrangement according to the second embodiment of the invention, shown in its third position, i.e. in a position where both the key part 7 and the turning part 8 are arranged to be attached to the gun 17. The drawing also shows the aperture 16 and the loop 15.

What is claimed is:

1. A method for locking a gun that includes a firing pin and a lock cylinder provided with a lock cylinder bracket, the method comprising:

providing the firing pin with a recess that essentially conforms to the lock cylinder bracket both in shape and in size, wherein the bracket has at least two positions including a first position and second position, and that in the first position, the bracket is fitted in the recess, so that the firing pin is movable towards the lock cylinder; and that in the second position, the bracket is not fitted in the recess, thereby preventing the firing pin from moving towards the lock cylinder and consequently locking the gun.

2. A locking arrangement for a pinlock of a gun, the locking arrangement comprising:

a lock cylinder provided with a bracket, and a firing pin provided with a recess that essentially conforms to the lock cylinder bracket both in shape and in size, and wherein the bracket has at least two positions including a first position and second position, in the first position, the bracket is fittable in the recess and the firing pin is movable towards the lock cylinder; in the second position, the bracket is not fittable in the recess, thus preventing the firing pin from moving towards the lock cylinder, and consequently locking the gun and preventing the cocking thereof.

3. A locking arrangement according to claim 2, wherein the bracket of the lock cylinder is arrangeable in various positions using a key of the lock cylinder.

4. A locking arrangement according to claim 3, wherein the key comprises a key part and a turning part, wherein the turning part is adapted to be detachable from the key part.

5. A locking arrangement according to claim 3, wherein the key is removable from the lock cylinder, when the bracket is in the first position.

6. A locking arrangement according to claim 3, wherein the key is non-removable from the lock cylinder, when the bracket is in the first position.

7. A locking arrangement according to claim 2, wherein the locking arrangement is mountable to a gun at a manufacturing stage thereof.

8. A locking arrangement according to claim 2, wherein the locking arrangement is mountable to a ready-made gun.

9. A method for locking a gun, the gun including a lock cylinder provided with a bracket, and a firing pin provided with a recess that conforms to the bracket both in shape and size, the method comprising:

placing the bracket in a first position to allow the bracket to fit into the recess to enable the firing pin to move towards the lock cylinder; and placing the bracket in a second position so that the bracket does not fit into the recess to prevent the firing pin from moving toward the lock cylinder, thereby locking the gun and preventing cocking thereof.

* * * * *